US011988077B2

(12) United States Patent
Louden et al.

(10) Patent No.: US 11,988,077 B2
(45) Date of Patent: May 21, 2024

(54) DOWNHOLE METHOD AND APPARATUS

(71) Applicant: ISOL8 (HOLDINGS) LIMITED, Aberdeen (GB)

(72) Inventors: Andrew Louden, Old Aberdeen (GB); William Edward Lowry, Port Townsend, WA (US)

(73) Assignee: ISOL8 (HOLDINGS) LIMITED, Aberdeen (GB)

( * ) Notice: Subject to any disclaimer, the term of this patent is extended or adjusted under 35 U.S.C. 154(b) by 193 days.

(21) Appl. No.: 17/606,218

(22) PCT Filed: Apr. 26, 2020

(86) PCT No.: PCT/EP2020/025190
§ 371 (c)(1),
(2) Date: Oct. 25, 2021

(87) PCT Pub. No.: WO2020/216475
PCT Pub. Date: Oct. 29, 2020

(65) Prior Publication Data

US 2022/0205342 A1 Jun. 30, 2022

(30) Foreign Application Priority Data

Apr. 26, 2019 (GB) ..... 1905824

(51) Int. Cl.
*E21B 33/12* (2006.01)
*E21B 43/10* (2006.01)
(Continued)

(52) U.S. Cl.
CPC ..... *E21B 43/105* (2013.01); *E21B 33/1208* (2013.01); *E21B 29/10* (2013.01); *E21B 33/1285* (2013.01); *E21B 36/008* (2013.01)

(58) Field of Classification Search
CPC .... E21B 43/105; E21B 33/1208; E21B 29/10; E21B 33/1285; E21B 36/008; E21B 43/103; E21B 33/1212
See application file for complete search history.

(56) References Cited

U.S. PATENT DOCUMENTS 3,716,101 A * 2/1973 McGowen, Jr. .... E21B 33/1295 166/120
5,833,001 A * 11/1998 Song ..... E21B 29/10 166/57
(Continued)

FOREIGN PATENT DOCUMENTS

CA 2898068 A1 1/2016
GB 2529275 A 2/2016
(Continued)

OTHER PUBLICATIONS

International Search Report and Written Opinion for Int. App. No. PCT/EP2020/025190, dated Jul. 16, 2020.

*Primary Examiner* — Carib A Oquendo
(74) *Attorney, Agent, or Firm* — MCDONNELL BOEHNEN HULBERT & BERGHOFF LLP

(57) ABSTRACT

A downhole method comprises expanding a patch member. The patch member may be employed in a method of sealing a wall of a bore. The sealing method may comprise: providing the patch member with a sealing material on an exterior surface; running the patch member into the bore in a smaller diameter first configuration; heating the sealing material to render the sealing material flowable; reconfiguring the patch member to a larger diameter second configuration; and hardening the sealing material to provide a seal between the exterior surface of the patch member and an inner surface of the bore.

18 Claims, 6 Drawing Sheets

(51) Int. Cl.

| | |
|---|---|
| *E21B 29/10* | (2006.01) |
| *E21B 33/128* | (2006.01) |
| *E21B 36/00* | (2006.01) |

(56) References Cited

U.S. PATENT DOCUMENTS

| | | | | |
|---|---|---|---|---|
| 2003/0015246 | A1 | 1/2003 | Hardin | |
| 2005/0023002 | A1* | 2/2005 | Zamora | D04C 1/06 166/380 |
| 2007/0199693 | A1 | 8/2007 | Kunz | |
| 2009/0183879 | A1 | 7/2009 | Cox | |
| 2009/0314497 | A1* | 12/2009 | Johnson | E21B 23/0412 166/212 |
| 2010/0038076 | A1* | 2/2010 | Spray | E21B 43/103 166/207 |
| 2012/0305253 | A1* | 12/2012 | O'Malley | E21B 43/105 166/387 |
| 2015/0021030 | A1 | 1/2015 | Loginov et al. | |
| 2015/0267501 | A1* | 9/2015 | Al-Gouhi | E21B 33/12 166/299 |
| 2016/0090812 | A1 | 3/2016 | Zhao et al. | |

FOREIGN PATENT DOCUMENTS

| | | | |
|---|---|---|---|
| WO | 2011/087721 | A1 | 7/2011 |
| WO | 2016/049424 | A1 | 3/2016 |
| WO | 2018/063829 | A1 | 4/2018 |

* cited by examiner

DOWNHOLE METHOD AND APPARATUS

CROSS REFERENCE TO RELATED APPLICATIONS

The present application is a U.S. National Phase Application pursuant to 35 U.S.C. § 371 of International Application No. PCT/EP2020/025190 filed Apr. 26, 2020, which claims priority to United Kingdom Patent Application No. 1905824.7 filed Apr. 26, 2019. The entire disclosure contents of these applications are herewith incorporated by reference into the present application.

FIELD

This disclosure relates to downhole methods and downhole apparatus which may utilize the expansion of a fluid. The methods may be utilized for sealing tubing such as bore-lining tubing as used on the oil and gas exploration and production industry.

BACKGROUND

In the oil and gas industry bores are drilled from surface to access subsurface hydrocarbon-bearing formations. The drilled bores are supported and sealed using metal tubing known as casing or liner. Distal portions of some bores are neither supported or sealed and contain tubing for carrying fluid to surface, which may be referred to as a completion.

Casing and liner are typically impervious and prevent fluid from flowing between the surrounding formations and the bore. A completion may include flow ports to control the flow of fluid through the wall of the completion. Such tubing may be subject to wear or damage and the integrity of the tubing may be compromised. In other cases, it may be desired to close perforations or other flow ports provided in the tubing wall.

A section of tubing wall may be isolated by running a length of smaller diameter tubing into the bore to straddle the compromised section of bore-lining tubing. Packers are provided towards the ends of the smaller diameter tubing and may be set to seal the annulus between the two lengths of tubing. Alternatively, a patch of material may be run into the bore and fixed to or urged against an inner surface of the compromised tubing, such as is described in U.S. Pat. No. 5,833,001.

SUMMARY

According to an example of the disclosure there is described a downhole method comprising heating a contained or constrained downhole fluid to expand the fluid.

Another example of the disclosure relates to downhole apparatus comprising a heater and a container for receiving a volume of fluid, wherein operation of the heater heats and expands the fluid.

The fluid expansion may be harnessed to, for example, expand a container such as a bladder, increase fluid pressure in a container, or generate a mechanical force, for example to generate an axial or radial force. The fluid expansion may be utilized to displace another material, for example the expanding fluid may act on a piston which is translated through a cylinder containing another material to displace the other material from the cylinder, for example to bail or jet the other material. The constrained fluid may also be used to transfer heat to an adjacent member or object.

The heater may be an exothermic reaction heater, for example a thermite heater.

The downhole fluid may comprise liquid, for example water. Alternatively, or in addition, the downhole fluid may comprise gas.

At least a portion of the downhole fluid may change phase, for example from a liquid to a gas. In other aspects the fluid may be initially provided in solid form and change phase to a liquid, which liquid may subsequently change phase to a gas, or in certain conditions the solid may undergo sublimation and change directly to a gas.

The fluid may be contained within an enclosure having a movable wall portion, for example the enclosure may comprise a bladder or a piston. The movable wall portion may thus be used to provide a mechanical force, which may be axial or radial.

Heating the downhole fluid may cause at least a portion of the fluid to exit a container, for example as a jet or high velocity stream, or the expanding fluid may be used to displace another material or fluid.

According to a further example of the disclosure, there is described a method of sealing a wall of a bore, the method comprising:

providing a patch member with a sealing material on an exterior surface thereof;

running the patch member into a bore in a smaller diameter first configuration;

heating the sealing material to render the sealing material flowable;

reconfiguring the patch member to a larger diameter second configuration; and hardening the sealing material to provide a seal between the exterior surface of the patch member and an inner surface of the bore.

The steps of the method may be carried out in the order as set out above, or may be carried out in a different order, or some steps may be commenced before other steps and then continue during and beyond other steps. For example, the heating of the sealing material may commence before the patch member is reconfigured to the larger diameter second configuration, and then continue as the patch member is reconfigured, and further continue after the patch member has been reconfigured.

According to a still further example of the disclosure there is provided downhole apparatus comprising:

a heater;

a patch member having a smaller diameter first configuration and a larger diameter second configuration; and a sealing material on an exterior surface of the patch member, the heater being operable to soften the sealing material whereby the sealing material may subsequently harden and provide a seal between the exterior surface of the patch member and an inner surface of a surrounding bore wall.

One or both of an inner diameter and an outer diameter of the patch member may increase between the first and second configurations. Increasing the inner diameter of the patch member may reduce or minimize the reduction in internal diameter that is created by setting the patch member in the bore; a reduction in the internal diameter may have an adverse effect on the production capabilities of the bore and may restrict access to the bore below the set patch member.

A patch member and a sealing member may provide an alternative example of the disclosure.

The heater may be run into the bore with the patch member. The heater may take any appropriate form. The heater may be an exothermic reaction heater and may be a thermite heater. The thermite may be of any appropriate composition of metal and metallic or non-metallic oxide which will react exothermically to form a more stable oxide and the corresponding metal or non-metal of the reactant oxide. For example, the thermite may comprise a mix of iron oxide and aluminium. If heated to an appropriate initiation temperature, for example 800-1300° C., the iron oxide/aluminium thermite may react exothermally and generate temperatures of up to, for example, 2900° C.

The heater may expand or cause expansion and facilitate reconfiguring of the patch member from the first configuration to the second configuration. For example, the heater may be an exothermic reaction heater and the exothermic reaction may generate gas or lower density material which occupies a larger volume. Alternatively, or in addition, the heater may heat a material which expands with increasing temperature, for example the heater may heat a fluid, such as water, which fluid may be constrained or contained. The fluid may be contained within a vessel or container having a movable wall portion. The fluid container may be a bladder, or the fluid may communicate with a piston and cylinder arrangement such that expansion of the fluid tends to translate the piston. The expanding material may generate an axial or radial force. The material to be expanded may be selected to provide predetermined characteristics, for example expansion characteristics or heat capacity.

The patch member may be generally tubular or cylindrical and define an internal volume and at least a part of the heater may be located within the volume. Alternatively, or in addition, at least a part of the heater may be located above or below the patch member. One or more heaters may be provided. A first heater may be provided for use while the patch member is in the first configuration. A second heater may be provided for use while the patch member is in the second configuration, or as the patch member is transitioning from the first configuration to the second configuration.

The patch member may remain in the solid phase as the patch member is reconfigured. The patch member may comprise material having a higher melt point than the sealing material.

The hardened sealing material may substantially fill a volume between the patch member and the inner surface of the bore.

The sealing material may be hardened by allowing the softened sealing material to cool. For example, the sealing material may be solid at the ambient temperature in the bore such that an absence of heating allows the sealing material to solidify or otherwise harden. Thus, for application in high pressure, high temperature (HPHT) wells, the freezing or solidification temperature of the sealing material will be in excess of 150° C., and certainly higher than the ambient temperature in the bore.

The sealing material may comprise a low melt point alloy such as a Bismuth Tin (Bi/Sn) alloy and may be a eutectic alloy. The alloy may be a 58/42 Bismuth Tin (Bi/Sn) alloy, which melts/freezes at 138° C. An alloy will be denser than the fluid filling the well, typically water or brine, and will therefore displace the ambient well fluid from between the exterior surface of the patch member and the inner surface of the bore, facilitating creation of a secure and fluid-tight bond. The relatively high density of the alloy will also result in flowable or molten alloy behaving in a relatively predictable manner, Alloys may be selected for high mobility such that the molten or flowable allow may flow into and occupy fine cracks or flaws in the bore wall, The solidified alloys may thus be effective in sealing damaged or otherwise porous or perforated bore walls, and may also securely engage the bore wall. Alloys may be selected to be compatible with the other elements of the apparatus and the bore wall material, and to be compatible with the conditions in the bore, for example relatively high ambient bore temperatures or the presence of corrosive materials, such as hydrogen sulphide and carbon dioxide, which might degrade or otherwise adversely affect other materials. Alternatively, or in addition, the sealing material may comprise a thermoplastic or some other material or blend of materials. In its hardened state the sealing material may comprise an amorphous solid or a highly viscous liquid.

The sealing material may be provided in combination with a structure for retaining the flowable sealing material distributed on and around the patch member. The structure may take any appropriate form and may include two or more different forms. The structure may define individual cells or pockets for containing the sealing material, such as a honeycomb form, or multiple circumferentially-extending ribs, or the sealing member may be dispersed or provided within a mat of woven or non-woven fibres or some other porous or cellular web such as may be used as a soldering wick. Alternatively, or in addition, the sealing material comprises a composition which is relatively viscous, for example a low melt point alloy mixed with a high-melt point material which restricts or hinders the ability of the molten alloy to flow.

The apparatus may include one or more seal members for restricting or preventing flow of the sealing material from a sealing area between the patch member and the bore wall. The seal member may comprise a radially extending rib configured to engage and seal with the bore wall. The rib may be flexible and may comprise a material or materials selected such that the seal member retains its integrity when exposed to elevated temperatures.

A sheath or sleeve may be provided externally of the sealing material and may serve to protect the sealing material as the apparatus is run into the bore. Alternatively, or in addition, the sheath or sleeve may assist in retaining the flowable sealing material distributed on and around the patch member. The sheath member may be or may become impregnated with the sealing material. The sheath member may take any appropriate form and may comprise any appropriate material. In one example the sheath is formed of braided fibre, for example a braided metal wire, such as braided copper wire, or a braided carbon fibre. The sheath member may be formed by any appropriate method and may be 3D-printed.

When in a flowable condition, the sealing material may flow into and at least partially occupy any perforations, cracks, gaps, depressions or pitted areas in the bore wall, and may further flow into and at least partially occupy any perforations, cracks or gaps in the surrounding formation.

The patch member may be restrained in the first configuration such that removal or release of restraints allows the patch member to expand towards the second configuration. Alternatively, or in addition, the patch member may be expanded towards the second configuration by application of an expanding force. Alternatively, or in addition, the patch member may be expanded towards the second configuration by an energy input, for example by heating. Alternatively, the patch member may comprise a shape memory material, such as a shape memory alloy, and at the ambient temperature in the bore the patch member returns, or attempts to return, to an original shape, corresponding to the second configuration or to a still larger diameter configuration.

The sealing material may assist in restraining or maintaining the patch member in the first configuration. In the first configuration portions of the patch member may overlap and the sealing material may be provided between the overlapping portions and bond the portions. Rendering the sealing material flowable may permit relative movement between the overlapping portions. Alternatively, or in addition, the sealing material, or at least portions of sealing material, may encircle and restrain the patch member.

The hardened sealing material may assist in maintaining the patch member in the second configuration. The hardened sealing material may bond the patch member to the inner surface of the bore. In the second configuration portions of the patch member may overlap and the sealing material may be provided between the overlapping portions and bond the portions together and thus contribute to maintaining the relative positions of the portions.

The patch member may be reconfigured from the first configuration to the second configuration at least in part by an expanding medium or member, which medium or member may be provided internally of the patch member. The expanding medium or member may expand on heating. In one example a volume of material is provided and swells or expands on heating, for example a fluid-filled bladder may be provided. The bladder may take any appropriate form and may be formed of any appropriate material. Any appropriate fluid, such as water, may be provided within the bladder.

A heat transfer medium may be provided between the heater and the patch member. The heat transfer medium may take any appropriate form. The heat transfer medium may comprise a flowable material and may provide a heat transfer path between the heater and the patch member as the patch member is reconfigured to the second configuration. The heat transfer medium may be contained or constrained, for example, within one or more bladders or bellows or between seals. In the absence of restrictions on the movement of the heat transfer medium, the heat transfer medium may carry heat away from the heater and the patch member. For example, if a heater is located in a fluid-filled well bore and is separated from a patch by an annular fluid-filled space, the fluid in the space will rise in temperature following activation of the heater but will then tend to move upwards to be replaced with cooler fluid from elsewhere in the bore. Well fluid is typically water or water-based, and water has a high coefficient of heat and will thus be effective in absorbing energy and, unless constrained, will tend to absorb energy from the heater and then move upwards and away from the heater and the patch member. Thus, much of the energy generated by the heater will be lost and will not be effective in heating the patch member and the sealing material. The heat transfer medium may comprise water or another liquid. The heat transfer medium may also expand on heating to assist in the reconfiguration of the patch member from the first configuration to the second configuration. The heat transfer medium may absorb heat generated by the heater and release the heat over an extended period. The heat transfer medium may be selected to have a high specific heat capacity if it is desired to have the medium absorb heat, but in other examples a heat transfer medium with a lower specific heat capacity may be selected if it is desired to have the medium absorb less of the energy generated by the heater.

A flux material may be provided to facilitate bonding between the sealing material and the bore wall or bonding between the sealing material and the patch member. The flux material may be provided in any suitable form and at any suitable location. For example, the flux material may be intermixed with the sealing material and may flow with the sealing material when the sealing material is fluidised. The flux material may be selected from organic or inorganic acid flux compounds commonly used in solder or low melt temperature alloy joining processes. These fluxes serve to deoxidize the surfaces and enhance the wettability of the metals being joined.

The bore wall may constrain the patch member in the second configuration, that is if unrestrained the patch member would tend to assume a still larger diameter third configuration.

The patch member may comprise a sheet material, such as a sheet of spring steel or other metal. The sheet material may be continuous or may be perforated or slotted or otherwise pervious or porous. In the first configuration the patch member may be in the form of a sprung coil and which coil at least partially unwinds to achieve the second configuration. A single continuous coil may be provided. Alternatively, multiple sheet portions may be provided. In the second configuration the patch member may comprise multiple layers of sheet material, for example two, three, four or more layers. The sealing material, or another material, may extend between layers of the sheet material to form a laminate, which structure may provide enhanced strength and crush resistance.

The patch member may comprise a coil of material, leaves or petals, or may be of tubular form.

The method may include inspecting or testing the bore wall. Inspection or testing apparatus may be run into the bore with the patch member and may be used to locate or identify areas of the bore wall before emplacing the patch member. For example, the inspection or testing apparatus may be utilized to identify bore wall integrity issues, such as areas of erosion, corrosion, or cracking, or detect gas or water breakthrough. Inspection or testing apparatus may be utilized to ensure that the patch member has been correctly located in the bore and has remedied the relevant bore wall integrity issue. The inspection or testing apparatus may take any appropriate form and may include a side-wall camera or ultrasonic detection apparatus. Images or information from the apparatus may be communicated to surface by any appropriate mechanism, for example via electric wireline or optical fibre.

The apparatus may be run into the bore on any suitable support such as jointed pipe or a reelable support such as wireline or coil tubing.

The various examples of the disclosure may be combined and features of one example of the disclosure may be utilized in combination with features of another example of the disclosure. The various features described above may have individual utility and may be combined with any other feature described herein or may be combined with any of the features set out in the appended claims.

BRIEF DESCRIPTION OF THE DRAWINGS

Examples of the disclosure will now be described with reference to the accompanying drawings, in which.

DETAILED DESCRIPTION

Figure 1:
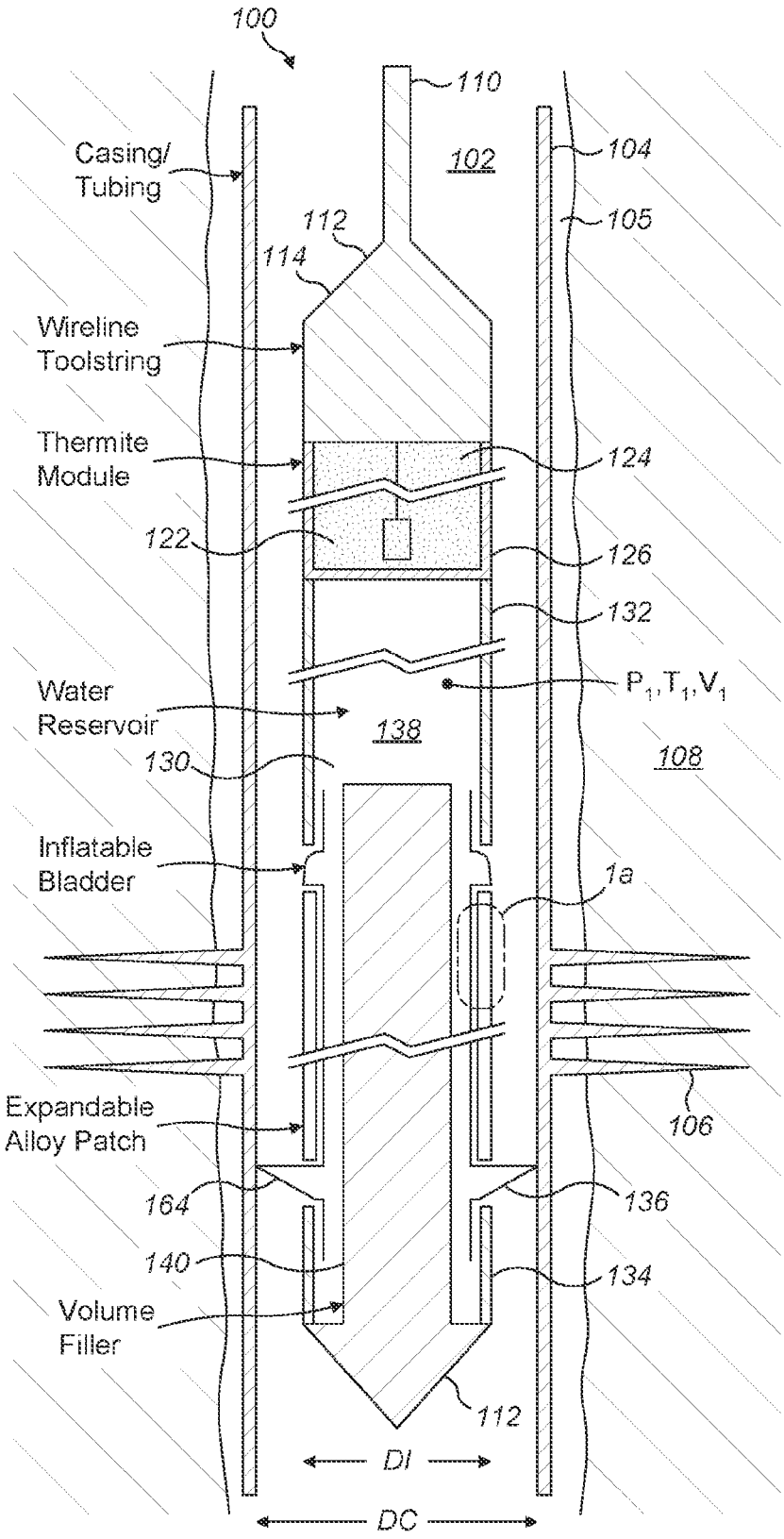
FIG. 1 is a sectional view of sealing apparatus according to a first example of the present disclosure in a first configuration.

Reference is first made to FIG. 1 of the drawings which illustrates seal-forming apparatus 100 in accordance with a first example of the disclosure. The apparatus 100 is illustrated located within a bore 102 that has been drilled to access a sub-surface hydrocarbon-bearing formation 108. The bore 102 is lined with steel tubing, for example casing 104. The casing 104, a surrounding cement annulus 105 and the formation 108 may have previously been deliberately perforated 106 to permit fluid communication between the formation 108 and the bore 102. Alternatively, the casing 104 may have originally featured a continuous wall to isolate the formation 108 from the bore 102 but has subsequently been damaged or degraded to the extent that the casing 104 has become perforated or the integrity of the casing 104 is at risk.

As will be described, the apparatus 100 is utilized to seal the perforated section of tubing 104 to isolate the formation 108 from the bore 102. The apparatus 100 is run into the bore 102 from surface and is supported on wireline 110. The location of the section of casing 104 to be sealed may have been known or identified by previous surveys, or the apparatus 100 may include inspection or detection apparatus 112, provided on upper or lower portions of the apparatus 100, and which may be incorporated in the wireline tool string 114. The inspection or detection apparatus 112 may include side-wall cameras, ultrasonic detection apparatus or the like which may be utilized to identify or locate the location where the apparatus 100 is to be set.

The apparatus 100 includes a thermite heater 122 comprising a volume of thermite 124. The thermite of this example comprises a mix of iron oxide and aluminium. When the heater 122 is activated an exothermic reaction is initiated, creating thermite reaction products in the form of iron and aluminium oxide. The thermite may be provided in any appropriate form and is retained within a heat-resistant cylindrical casing 126. The thermite 124 has a composition selected such that the thermite tends to retain its form during and after activation of the heater 122. This may be achieved by incorporating a high melt temperature material within the thermite mix, which tends to restrict flow of the molten iron and molten aluminium oxide and results in a final reaction product mix in which the iron is dispersed within the aluminium oxide, rather than the iron settling out at the base of the heater 122. The heater 122 includes an initiator 128 which may be activated to generate a temperature sufficient to start the thermite reaction.

In this example the heater 122 is provided at the upper end of a water-filled reservoir 130. The walls of the reservoir 130 include rigid cylindrical portions 132, 134 and a flexible portion comprising a bladder 136 held between the rigid portions 132, 134. As will be described, the volume of water 138 in the reservoir 130 is selected to undergo a predetermined degree of heating and to provide a predetermined degree of expansion. The volume of water 138 within the reservoir 130 may be varied by selecting an appropriate filler volume 140 for location within the reservoir 130.

Figure 2:
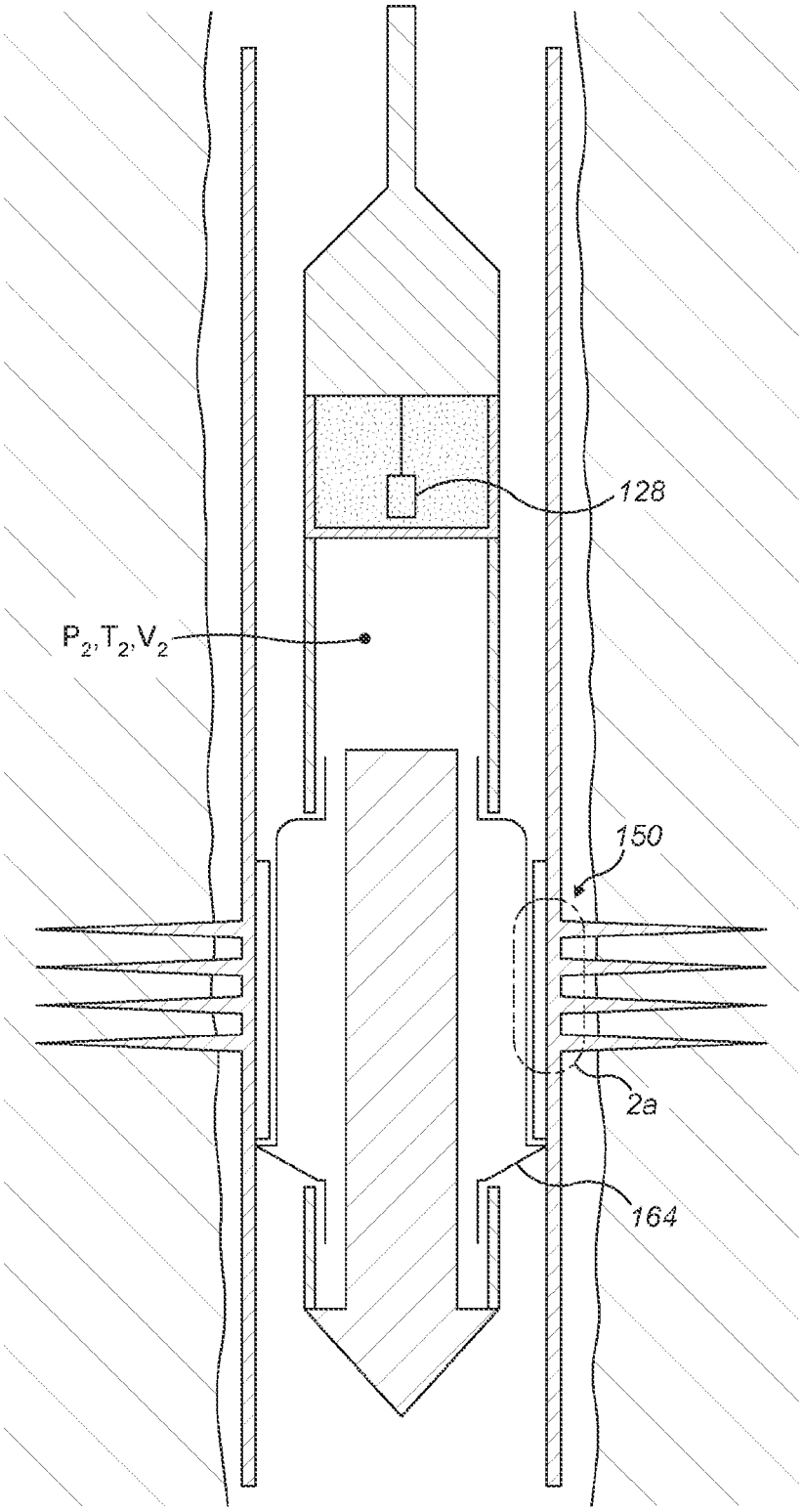
FIG. 2 is a sectional view of the sealing apparatus of FIG. 1 in a second configuration.
Figure 2A:
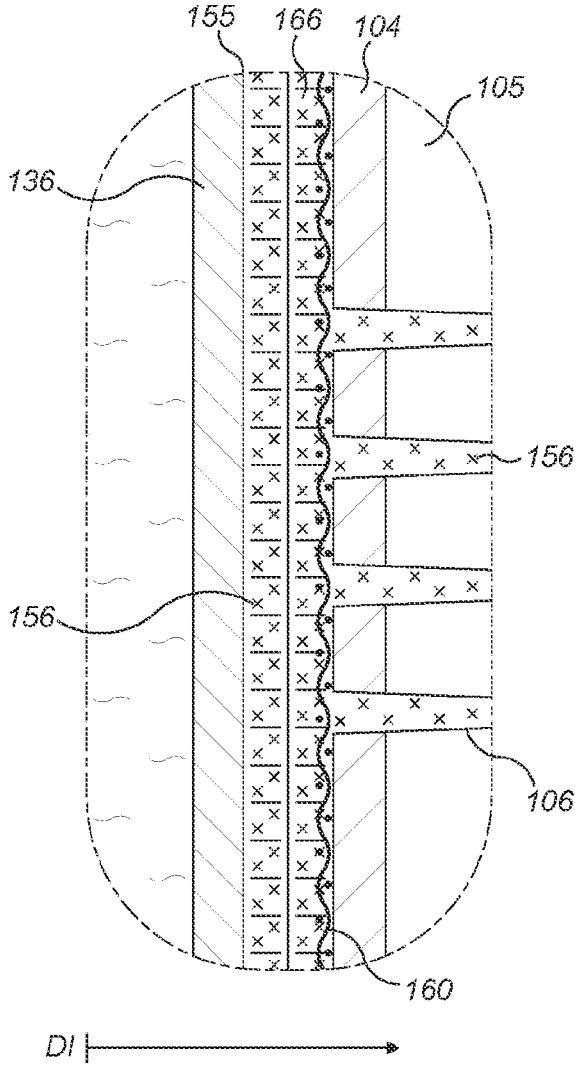
FIG. 2*a* is an enlarged sectional view of area 2*a* of FIG. 2.

Mounted between the rigid cylindrical wall portions 132, 134 and surrounding the bladder 136 is a patch-forming apparatus 150 having a first configuration, as illustrated in FIG. 1, in which the apparatus 150 has an installation diameter DI smaller than the casing diameter DC, to permit the apparatus 100 to be run into the bore 102 and located within the compromised section of casing 104. As will be described, by activating the heater 122 the patch-forming apparatus 150 is reconfigured to a second configuration in which the apparatus 150 assumes a larger diameter and engages with and seals the inside surface of the casing 104, as illustrated in FIG. 2 of the drawings.

Figure 1A:
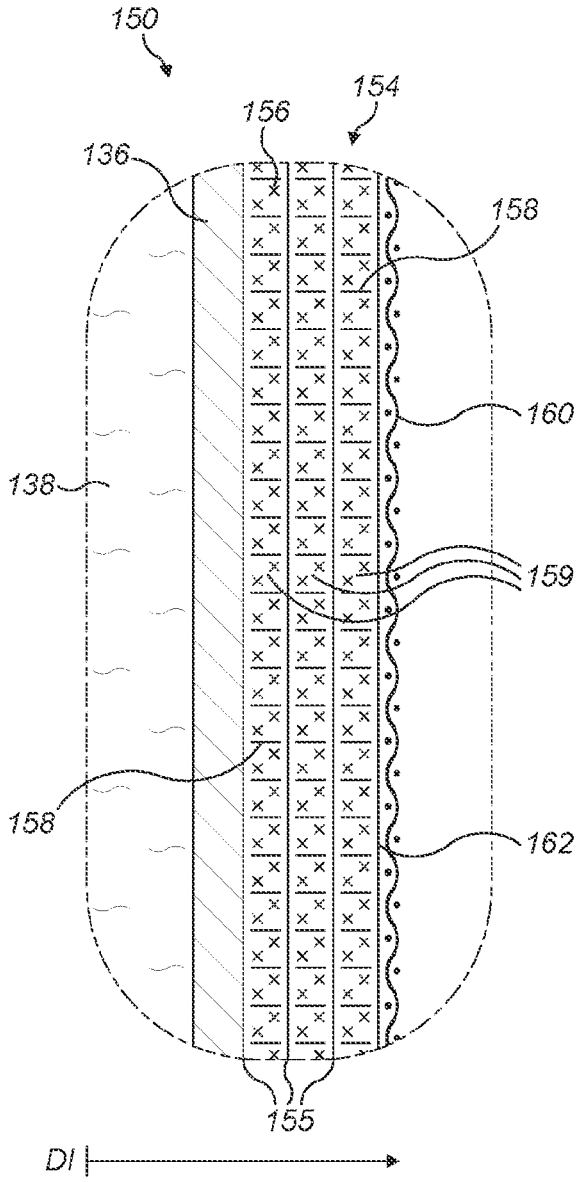
FIG. 1*a* is an enlarged sectional view of area 1*a* of FIG. 1.

The patch-forming apparatus 150 is shown in greater detail in FIG. 1*a* of the drawings and includes a patch member or inner wall 154 which is extendable or expandable to describe the larger diameter. In this example the wall 154 comprises a coil of spring steel, and as illustrated in FIG. 1*a* the steel sheet has been wound to form three concentric layers 155.

Provided on, between and around the layers 155 of the inner wall 154 is a sealing or seal-forming material 156. In the illustrated example the material 156 also assists in retaining the inner wall 154 in the first configuration and at the initial diameter DI. The material 156 is a low melt alloy, for example Bismuth Tin (Bi/Sn), and may be a 58/42 Bi/Sn alloy having a melting/freezing temperature of 138° C. The alloy is provided in combination with a structure 158 for retaining molten alloy on and around the wall 154, in this example a structure 158 defining individual cells, in a honeycomb form. The structure 158 may be formed of any appropriate material, for example an aramid polymer such as sold under the Nomex trademark.

As noted above, the inner wall 154 is retained in a smaller diameter first configuration DI by the seal-forming material 156: the volume 159 between the overlapping layers 155 of the coiled wall 154 is filled with the material 156 and the material 156 is bonded to the wall surfaces. The material 156 thus prevents relative sliding movement between the overlapping layers 155.

A sheath 160 forms an outer wall of the apparatus 150 and serves to protect the seal-forming material 156 as the apparatus 100 is run into the bore 102. The sheath 160 may take any appropriate form and in this example is braided copper wire.

Flux material 162 may be provided between the sheath 160 and the seal-forming material 156. As will be described, the flux 162 facilitates creation of a secure bond between the seal-forming material 156 and the casing 104.

A high temperature circumferential seal 164 is provided towards a lower end of the patch-forming apparatus 150. The seal 164 extends radially between the concentric layers 155 and is dimensioned to form a sliding seal with the tubing 104.

To seal the perforations 106 in the tubing 104, the operator positions the apparatus 100 in the bore 102 such that the patch-forming apparatus 150 extends across the perforated zone, as illustrated in FIG. 1. The initiator 128 is then initiated to activate the heater 122. The thermite 124 within the heater 122 then begins to react and generate high temperatures (up to 2900° C.). The temperature of the water 138 in the reservoir 130 rises (to 200° C. or more) and transfers heat to the patch-forming apparatus 150. After a relatively short time the apparatus 150 is heated to a temperature sufficient to melt the alloy 156, allowing the coiled inner wall 154 to unwrap and move towards the larger diameter second configuration, as illustrated in FIG. 2. As is apparent from FIG. 2. both the inner diameter and the outer diameter of the wall 154 increase.

In addition to transferring energy from the heater 122 to the patch-forming apparatus 150, the water 138 also expands as the water temperature increases. Given the elevated hydrostatic pressures experienced in a deep fluid-filled bore, the water 138 will not undergo a conventional phase change but will tend to significantly increase in volume while remaining in the liquid phase. At typical depths of operation, where the fluid pressure exceeds 200 atmospheres (20265 kPa), the water 138 will increase in volume by a factor of as much as 15 to 30 due to the thermite heater 122 raising the local water temperature to 500 to 1000° C. The thermite reaction has the potential to heat the water 138 to such temperatures if the volume of the surrounding water is controlled, as is accomplished by providing with the heater 122 internal or contiguous to the bladder 136. The increase in volume inflates the bladder 136 and urges the wall 154 radially outwards and towards the inner surface of the tubing 104.

The alloy 156 on the external surfaces of the wall 154 will also have melted. As the molten alloy 156 is highly mobile there will be a tendency for the alloy 156 to flow downwards under the influence of gravity. However, the alloy 156 is retained between the wall 154 and the tubing within the honeycomb structure 158 and any alloy 156 which does flow downwards is retained above the circumferential seal 164. The molten alloy 156 will also infiltrate the sheath 160.

The flux material 162 will also be melted and flows with the alloy 156, carrying away contaminants and oxidation from the interface between the alloy 156 and the tubing 104. The presence of the flux material 162 also facilitates creation of a metallurgical bond between the alloy 156 and the surfaces of the casing 104 and the wall 154. The heated high-density alloy 156 will tend to displace the flux 162 and any other materials which might otherwise contaminate or compromise the creation of a secure bond between the alloy 156 and the casing 104. The molten alloy 156 will also flow into and fill any perforations, cracks, or fissures in the casing 104.

The expanding bladder 136 and the stored energy in the coiled patch member 154 tend to push the outermost layer 155 against the casing 104, however the presence of the alloy 156, the honeycomb structure 158 and the sheath 160 ensure that an annular space 166 remains between the layer 155 and the casing 104. The molten alloy 156 is dense and highly mobile and displaces well fluid and other loose materials from the space 166, such that a substantially continuous volume of alloy 156 occupies the space 166.

The heating effect provided by the heater 122, and the heated water 138, will continue for a time following the reconfiguring of the wall 154, ensuring that the heat penetrates the thickness of the wall 154 and fully mobilizes the alloy 156, including the alloy 156 on the outermost surface of the wall 154 which is furthest from the heat sources and in contact with the casing 104, and the well fluid which will be initially present in the space 166. Indeed, the casing 104 and the well fluid will also experience heating, preventing, or limiting premature freezing of the alloy 156 and facilitating the flowing of the molten alloy 156 to fully occupy the space 166.

Once the thermite reaction within the heater 122 has finished and the apparatus 100 has cooled, the temperature of the alloy 156 will fall and on reaching its solidification temperature the alloy 156 will freeze. The now-solid material 156 seals and bonds the outer surface of the wall 154 to the tubing 104. Further, a layer of alloy 156 remains between the overlapping layers 155 of the wall 154 in the still-coiled extended second configuration to create a crush-resistant laminate structure.

As the water 138 in the bladder 136 cools the volume of the water 138 will reduce, allowing the bladder 136 and the other elements of the apparatus 100 to be retrieved, leaving the patch-forming apparatus 150 in place. Retraction of the bladder 136 may be further assisted by a spring force or the like.

Figure 3:
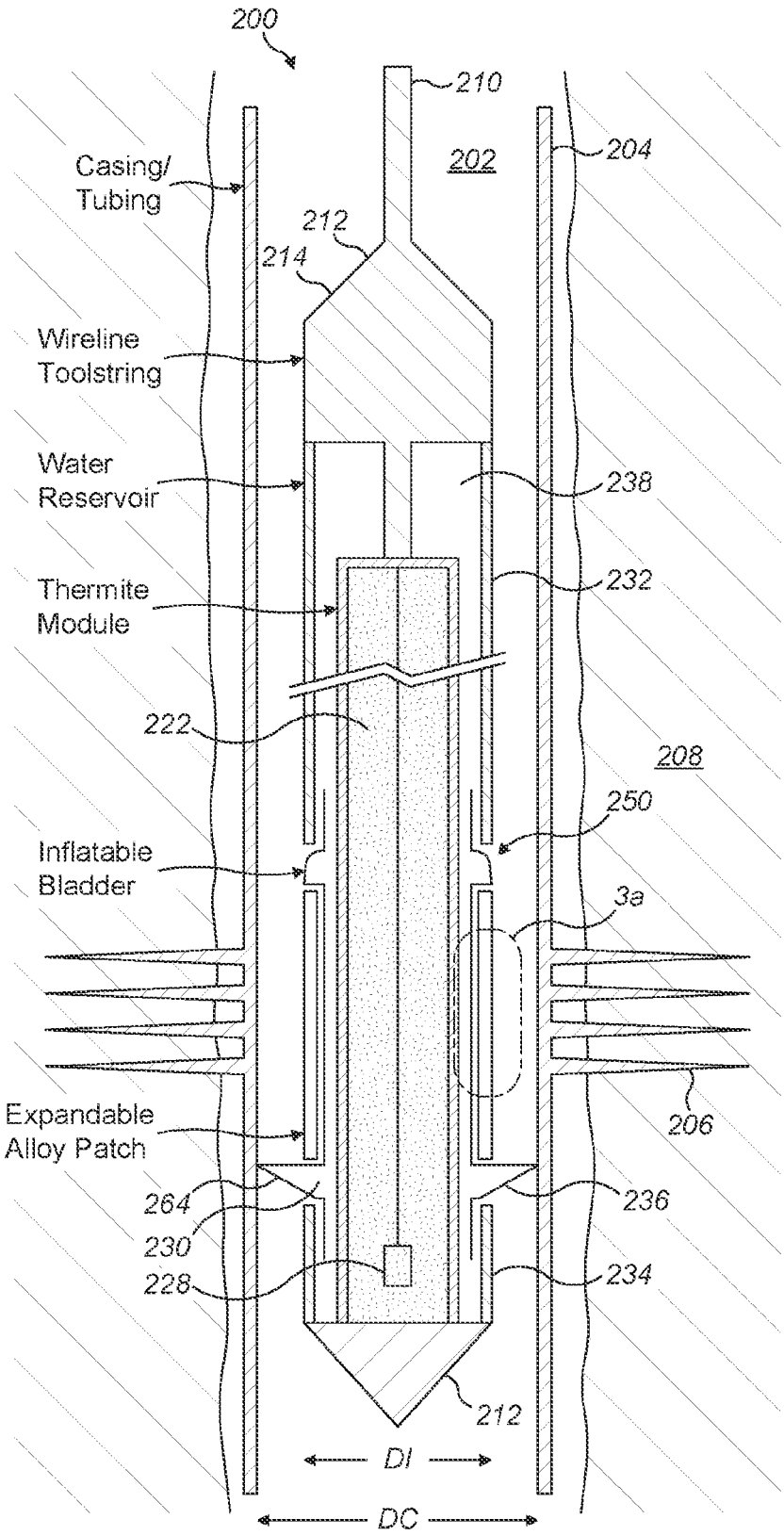
FIG. 3 is a sectional view of a sealing apparatus according to a second example of the present disclosure.
Figure 3A:
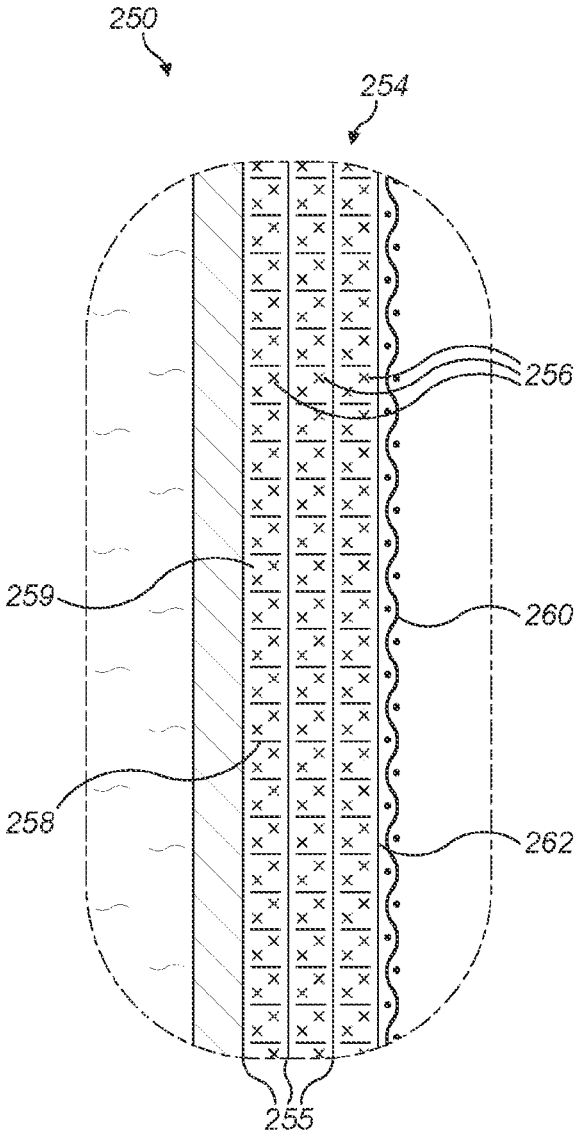
FIG. 3*a* is an enlarged sectional view of area 3*a* of FIG. 3.

Reference is now made to FIGS. 3 and 3*a* of the drawings, which illustrate seal-forming apparatus 200 in accordance with a second example of the disclosure. The apparatus 200 shares several features with the apparatus 100 described above and is illustrated in a similar setting, that is located within a bore 202 that has been drilled to access a subsurface hydrocarbon-bearing formation 208 and is lined with steel casing 204. The casing 204 is perforated 206 and allows fluid communication between the surrounding formation 208 and the bore 202.

As with first example, the apparatus 200 is utilized to seal the perforated section of tubing 204 to isolate the formation 208 from the bore 202. The apparatus 200 is run into the bore 202 from surface, supported on wireline 210. The apparatus 200 may include inspection and detection apparatus 212 mounted on the wireline tool string 214 which may be utilized to identify or locate the bore location where the apparatus 200 is to be set.

The apparatus 200 includes a thermite heater 222 which, in this example, is located towards the distal or lower end of the apparatus 200 and extends through the lower end portion of a water-filled reservoir 230. The walls of the reservoir 230 include rigid cylindrical portions 232, 234 and a flexible portion comprising a bladder 236 retained between the rigid portions 232, 234. The flexible bladder extends circumferentially around the heater 222.

Mounted between the rigid cylindrical wall portions 232, 234 and surrounding the bladder 236 is a patch-forming apparatus 250 having a first configuration, as illustrated in FIG. 3, in which the apparatus 250 has an installation diameter DI smaller than the casing diameter DC, to permit the apparatus 200 to be run into the bore 202 and located within the perforated section of casing 204. By activating the heater 222 the patch-forming apparatus 250 may be reconfigured to a second configuration in which the apparatus 250 assumes a larger diameter and engages with and seals the inner surface of the casing 204.

The patch-forming apparatus 250 is shown in greater detail in FIG. 3*a* of the drawings and includes a patch member or inner wall 254 which is extendable or expandable to describe the larger diameter. As with the first-described example the wall 254 comprises a coil of spring steel which is initially radially/circumferentially restrained to describe the installation diameter DI. The steel sheet is wound to form two, three or more concentric layers 255.

Mounted on and around the layers 255 of the inner wall 254 is a seal-forming material 256 which also assists in retaining the inner wall 254 in the first configuration and at the initial diameter DI. The material 256 may be a low melt point Bismuth Tin (Bi/Sn) alloy. The alloy is provided in combination with a honeycomb or braided structure 258 for retaining molten alloy distributed on and around the wall 254.

As noted above, the inner wall 254 is retained in a smaller diameter first configuration by the seal-forming material 256: the volume 259 between the overlapping layers 255 of the coiled wall 254 is filled with the material 256 and the material 256 is bonded to the wall surfaces.

A sheath 260 may form an outer wall of the apparatus 250 and serves to protect the seal-forming material 256 as the apparatus 200 is run into the bore. In this example the sheath 260 comprises braided copper wire.

Flux material 262 may be provided between the sheath 260 and the seal-forming material 256. The flux 262 facilitates creation of a secure bond between the seal-forming material 256 and the casing 204.

A high temperature circumferential seal 264 is provided at a lower end of the patch-forming apparatus 250. The seal 264 extends radially outwards from the inner wall 254 and provides a sliding seal with the tubing 204.

To seal the perforations 206 in the tubing 204, the operator positions the apparatus 200 in the bore 202 such that the patch-forming apparatus 250 extends across the perforated zone, as illustrated in FIG. 3. An initiator 228 is then initiated to activate the heater 222. The thermite within the heater 222 then begins to react and generate high temperatures (up to 2900° C.). The heater 222 transfers heat to the apparatus 250. Further, the temperature of the water 238 in the reservoir 230 rises and the water transfers further heat to the apparatus 250. After a relatively short time the apparatus 250 is heated to a temperature high enough to melt the alloy 256, allowing the coiled inner wall 254 to unwind and expand towards the larger diameter second configuration.

In addition to transferring energy from the heater 222 to the apparatus 250, the water 238 also expands as the water temperature increases. Given the elevated hydrostatic pressures experienced in a deep fluid-filled bore, the water will not undergo a conventional phase change but will tend to undergo a significant increase in volume while remaining in the liquid phase. At typical depths of operation, where the fluid pressure exceeds 200 atmospheres (20265 kPa), the water will increase in volume by a factor of as much as 15 to 30 due to the thermite heater raising the local water temperature to 500 to 1000° C. The thermite reaction has the potential to heat the water 238 to such temperatures if the volume of surrounding water is controlled, as is accomplished with the heater internal 222 to the bladder 236. The increase in volume inflates the bladder 236 and urges the wall 254 to uncoil and expand radially outwards and into contact with the wall of the tubing 204.

The alloy 256 on the external surface of the inner wall 254 will also have melted. The alloy 256 is retained between the wall 254 and the tubing 204 within the honeycomb or braided structure 258 and any alloy 256 which flows downwards is retained above the circumferential seal 264. The molten alloy 256 will also infiltrate and extend through the sheath 260.

The flux material 262 will also be melted or distributed by the heat and movement and will flow with the molten alloy 256, carrying away contaminants and oxidation from the interface between the alloy 256 and the tubing 204. The high-density alloy 256 will subsequently tend to displace the flux 262 and any other materials which might otherwise contaminate or compromise the creation of a secure bond between the alloy and the tubing 204 or the wall 254.

Once the thermite reaction within the heater 222 has been exhausted and the apparatus 200 has cooled, the temperature of the alloy 256 will fall and on reaching its solidification temperature the molten alloy 256 will freeze. The now-solid material 256 substantially fills and occupies the annular volume between the outermost layer 255 and the tubing 204 and thus seals and bonds the outer surface of the wall 254 to the tubing 204. Further, the alloy 256 between the overlapping layers 255 of the still coiled wall 254 fixes the coil in the extended second configuration.

As the water 238 in the bladder 236 cools the volume of the water 238 will reduce and the diameter described by the bladder 236 similarly reduce, allowing the bladder 236 and the other elements of the apparatus 200 to be retrieved while leaving the patch-forming apparatus 250 in place and the perforations 206 sealed.

In other examples of the disclosure the water reservoir may be omitted, and in such examples the heater may have a larger outer diameter to facilitate heat transfer from the heater to the patch-forming apparatus. In a further example two heaters may be provided, the first heater melting the alloy and permitting the inner wall to expand. The first heater may then be retrieved and a second heater having a larger diameter run into the bore for more effective heating of the expanded apparatus. Alternatively, the first and second heaters may be run into the bore together, with the second heater being translated into the patch-forming apparatus after the first heater has allowed the inner wall to expand to the second configuration.

In the examples described above a thermite heater is utilized. In other examples alternative heaters could be used, for example one or more electric heaters.

The description above refers primarily to use of the apparatus in casing 104, 204, however the apparatus may have utility in a wide range of tubing forms and formats that include openings permitting fluid communication through the tubing wall including but not limited to slotted tubing, perforated tubing, base pipe for sand screens, sliding sleeves, gas lift mandrels, control line ports subs, chemical injection ports and the like.

Reference is made above to the apparatus being run into the bore on wireline 110, 210, however the apparatus may be deployed on other forms of support including slickline, coiled tubing and jointed pipe.

The above examples include a honeycomb structure 158, 258 to assist in retaining the molten alloy on and around the walls 154, 254. In other examples an alternate or additional structure may be provided, such as a braided or non-woven web or layer. Such a structure may act as a physical barrier to prevent or limit flow of the molten alloy, or the structure may act as a wick for the molten alloy; the molten alloy, which may have a viscosity similar to water, may be drawn into and along the structure such that the alloy is distributed within the structure and also retained within the structure. If considered appropriate, the honeycomb structure 158, 258 itself may be formed of a wicking material, such as a compressed fibrous material.

The above examples feature a sealing material comprising an alloy such as Bismuth/Tin (Bi/Sn). The form, properties and composition of the sealing material may be selected by the operator to match the other features of the apparatus, such as the form or heat output of the heater or the location of the heater relative to the sealing material, and the form and composition of the patch member and the bore wall. The operator will also base the selection of the sealing material on the conditions in the bore, such as the ambient wellbore temperature, the presence of injected steam or other heated fluids in the well, or the presence of corrosive chemicals or compounds in the well. The sealing material may comprise a non-ferrous alloy. The properties of the alloy may be selected such that the alloy may be reliably softened or rendered flowable in the bore, and the alloy will likely have a lower melt point than the material forming the patch member. The alloy may have a melt point lower than aluminium (660° C.) or zinc (420° C.). The alloy may take any appropriate form and may be a bismuth-based alloy such as a bismuth/tin alloy as described above. Alternatively, the alloy may have a lower or higher melting temperature than Bi/Sn alloys. The alloy may be a Babbitt metal. The alloy may be a high tin alloy using copper, antimony, or other metal additives to achieve desired melt ranges and physical properties and may comprise 2.5-8.5% copper, 4-16% antimony, and <1% nickel. The alloy may be eutectic or non-eutectic. The alloy may include fillers that affect one or more properties of the alloy, such as the mobility of the molten alloy, the ability of the alloy to transfer heat, or the creep resistance of the alloy.

The use of alloys as a sealing material may avoid some of the problems associated with the use of resins and elastomer, as alloys tend not to degrade with age and tend to corrode very slowly, if at all. Also, alloys tend to withstand higher temperatures and temperature cycles.

When provided in combination with an appropriate flux, alloy sealing materials facilitate creation of a metallurgical bond between the tubing and the patch member.

Further modifications may be made to the foregoing examples within the scope of the present disclosure. For example, the disclosure is primarily concerned with sealing bores but in some situations it may be sufficient or desirable to merely restrict flow through a bore wall, or reinforce a bore wall, and in such cases the methods and apparatus described herein may be usefully employed even if a fluid-tight seal is not achieved.

The examples of the apparatus described above relate to use of the apparatus in sealing bores drilled to access hydrocarbon-bearing formations. The apparatus may equally have utility in other bores, for example thermal bores or bores drilled to access aquifers. Similarly, the apparatus may find utility in pipelines and the like.

The invention claimed is:

1. A method of sealing a wall of a bore, the method comprising:

providing a patch member comprising a sprung coil of layers of sheet material with a sealing material comprising a low melt point alloy on an exterior surface thereof;

running the patch member into a bore in a smaller diameter first configuration;

heating the sealing material to render the sealing material flowable;

reconfiguring the patch member by at least partially unwinding the coil to a larger diameter second configuration; and hardening the sealing material to provide a seal between the exterior surface of the patch member and an inner surface of the bore.

2. The method of claim 1, further comprising at least one of: transferring heat from a heater to the patch member and the sealing material via a constrained fluid; and heating and expanding a constrained fluid to reconfigure the patch member to the larger diameter second configuration.

3. The method of claim 1, comprising retaining flowable sealing material on the patch member using a wicking material.

4. The method of claim 1, comprising releasably retaining the patch member in the first configuration and then allowing the patch member to expand towards the second configuration.

5. The method of claim 1, comprising expanding the patch member towards the second configuration by application of an expanding force.

6. The method of claim 1, comprising utilizing the sealing material to maintain the patch member in the first configuration, and utilizing the hardened sealing material to assist in maintaining the patch member in the second configuration and to bond the patch member to the inner surface of the bore.

7. The method of claim 1, comprising at least one of: providing a material between the layers of the coil to form a laminate, and providing the sealing material between the layers of the coil to form a laminate.

8. The method of claim 1, comprising running inspection or testing apparatus into the bore simultaneously with the patch member.

9. A downhole apparatus comprising:

a heater;

a patch member comprising a sprung coil of layers of sheet material having a smaller diameter first configuration and a larger diameter second configuration in which the coil is at least partially unwound; and a sealing material comprising a low melt point alloy on an exterior surface of the patch member;

the heater being operable to soften the sealing material whereby the sealing material may subsequently harden and, with the patch member in the second configuration, provide a seal between the exterior surface of the patch member and an inner surface of a surrounding bore wall.

10. The apparatus of claim 9, wherein a contained fluid heat transfer medium is provided between the heater and the patch member.

11. The apparatus of claim 9, wherein the heater comprises at least one of an exothermic reaction heater, and a thermite heater.

12. The apparatus claim 9, wherein the sealing material is provided in combination with a structure for retaining flowable sealing material distributed on the patch member.

13. The apparatus of claim 12, wherein the structure defines at least one of: individual cells and pockets for containing the sealing material, a wicking material, and a seal member for restricting flow of the sealing material from a sealing area between the patch member and a surrounding bore wall.

14. The apparatus of claim 9, wherein the patch member is initially restrained in the first configuration, and in the first configuration portions of the layers of sheet material overlap and the sealing material is provided between the overlapping portions.

15. The apparatus of claim 9, comprising a contained volume of liquid, and wherein the heater is operable to heat and expand the liquid and reconfigure the patch member to the larger diameter second configuration.

16. The apparatus of claim 9, comprising a flux material to facilitate bonding between at least one of: the sealing material and the bore wall, and the sealing material and the patch member.

17. The apparatus of claim 9, wherein the patch member in the second configuration comprises multiple layers of the sheet material.

18. A downhole apparatus comprising:

a patch member comprising a sprung coil of layers of sheet material having a smaller diameter first configuration and a larger diameter second configuration in which the coil is at least partially unwound; and a sealing material comprising a low melt point alloy on an exterior surface of the patch member;

the sealing material being adapted to soften on heating whereby the sealing material may adapt to occupy a volume between the patch member in the second configuration and a surrounding bore wall and subsequently harden and provide a seal between the patch member and the bore wall.

* * * * *